US007181259B2

(12) United States Patent
Tsuzuki et al.

(10) Patent No.: US 7,181,259 B2
(45) Date of Patent: Feb. 20, 2007

(54) RESONATOR HAVING FOLDED TRANSMISSION LINE SEGMENTS AND FILTER COMPRISING THE SAME

(75) Inventors: Genichi Tsuzuki, Ventura, CA (US); Shen Ye, Cupertino, CA (US)

(73) Assignee: Conductus, Inc., Sunnyvale, CA (US)

( * ) Notice: Subject to any disclaimer, the term of this patent is extended or adjusted under 35 U.S.C. 154(b) by 25 days.

(21) Appl. No.: 10/480,743

(22) PCT Filed: Jun. 13, 2002

(86) PCT No.: PCT/US02/18897

§ 371 (c)(1),
(2), (4) Date: Jun. 25, 2004

(87) PCT Pub. No.: WO02/101872

PCT Pub. Date: Dec. 19, 2002

(65) Prior Publication Data

US 2004/0233022 A1 Nov. 25, 2004

Related U.S. Application Data

(60) Provisional application No. 60/298,339, filed on Jun. 13, 2001.

(51) Int. Cl.
*H01P 1/203* (2006.01)
*H01B 12/02* (2006.01)

(52) U.S. Cl. ..... 505/210; 333/99 S; 333/204; 333/219

(58) Field of Classification Search ..... 333/204, 333/219, 99 S; 505/210
See application file for complete search history.

(56) References Cited

U.S. PATENT DOCUMENTS

| | | | | |
|---|---|---|---|---|
| 4,701,727 | A | 10/1987 | Wong | |
| 5,055,809 | A | 10/1991 | Sagawa et al. | 333/219 |
| 5,986,525 | A | 11/1999 | Sasaki et al. | |
| 6,122,533 | A | 9/2000 | Zhang et al. | |
| 6,529,750 | B1 * | 3/2003 | Zhang et al. | 505/210 |

FOREIGN PATENT DOCUMENTS

| | | |
|---|---|---|
| JP | 1-319304 | 12/1989 |
| WO | WO 98/00880 | 1/1998 |
| WO | WO 99/00897 | 1/1999 |

* cited by examiner

*Primary Examiner*—Benny T. Lee
(74) *Attorney, Agent, or Firm*—Merchant & Gould P.C.

(57) ABSTRACT

A resonator and filter including the resonator is disclosed. The resonator (100) includes an open conductive loop (100) with folded transmission line segments (124, 134) extending from the adjacent ends of the loop. Of each transmission line segment, the portion emanating from the respective end of the loop is positioned generally along-side the corresponding portion of the other transmission line segment. That is, the two transmission line segments are folded away from each other. The resonator can be generally elongated in shape, with the loop at one end of the long axis and the transmission line segments at the other. The transmission line segments occupy a footprint (W2) that is not substantially greater than the width of the loop (W1). The filter includes multiple resonators of the invention, each resonator being coupled to at least another or the resonators. The resonators can be positioned in a side-by-side fashion, with the long axes of the resonators parallel or anti-parallel to one another.

16 Claims, 11 Drawing Sheets

RESONATOR HAVING FOLDED TRANSMISSION LINE SEGMENTS AND FILTER COMPRISING THE SAME

GOVERNMENT SUPPORT

This invention was made with United States Government support under cooperative agreement number 70NANBOH3032 awarded by the National Institute of Standards and Technology (NIST).

This application is being filed as a PCT International Patent application in the names of Genichi Tsuzuki, a Japanese citizen and resident of the United States of America, and Shen Ye, a Canadian citizen and resident of the United States of America, designating all countries, on 13 Jun. 2002.

BACKGROUND OF THE INVENTION

The present invention relates generally to transmission line circuits, such as stripline and microstrip filters, and particularly to filters with resonators producing reduced cross-coupling between the resonators and thereby improving filter performance.

Bandpass and band-reject filters have wide applications in the today's communication systems. The escalating demand for communication channels dictates better use of frequency bandwidth. This demand results in increasingly more stringent requirements for RF filters used in the communication systems. Some applications require very narrow-band filters (as narrow as 0.05% bandwidth) with high signal throughput within the bandwidth. The filter response curve must have sharp skirts so that a maximum amount of the available bandwidth may be utilized. Further, there is an increasing demand for small base stations in urban areas where channel density is high. In such applications, small filter sizes are desirable.

Desirable filter characteristics are often difficult to realize for a variety of reasons. For example, energy losses due to resistive dissipation and radiation contribute to decrease in the quality factor, Q, of a filter; uncontrolled cross-coupling through radiation among the resonators in a filter tends to degrade out-of-band performance or symmetry of the frequency response of a filter.

The present invention is directed to improving the performance of the above-described filters.

SUMMARY OF THE INVENTION

The invention provides filters such as microstrip and stripline circuits that are more compact, have less uncontrolled cross-coupling among its resonators and provide as good or better performance than is attainable with the technology of the prior art.

In accordance with the one aspect of the invention, a resonator includes (a) a conductive loop terminating in two adjacent ends, and (b) two transmission line segments, each emanating from one of the two loop ends and including a first and a second portions, wherein the first portions of the two segments are positioned generally alongside each other, and wherein the second portion of each of the two segments is substantially folded over the first portion of the same segment.

The resonator defines an orientation pointing generally along the first and second portions of the transmission line segments toward the conductive loop. The conductive loop has a width generally perpendicular to the orientation, and the transmission line segments occupy a footprint having a width generally perpendicular to the orientation. The width of the loop is significant compared to the width of the footprint. For example, the width of the loop can be at least 50% of the width of the footprint, or at least the same as the width of the footprint.

Each of the transmission line segments can have more than two folded portions. For example, each segment can have three or more folded portions.

In another aspect of the invention, a filter includes multiple resonators of the invention, wherein each resonator is coupled to at least another one resonator. The resonators can be positioned alongside each other, with the orientations of each adjacent pair of resonators being either parallel of anti-parallel to each other. The non-adjacent resonators can also be selectively coupled together via linkages that include a conductive path.

According to yet another aspect of the invention, a resonator may include a conductive loop terminating in a first end and a second end. The resonator also includes an inter-digital capacitor having a first end and a second end. A first transmission line connects the first end of the conductive loop to the first end of the inter-digital capacitor. Similarly, a second transmission line connects the second end of the conductive loop to the second end of the inter-digital capacitor. Filters may be constructed from a plurality of such resonators, each of which is coupled by a linkage terminated by a segment running substantially perpendicular such linkage.

The resonator and filter can be constructed by forming conductive patterns on a dielectric substrate. For example, superconductors, such as high-temperature superconductors, can be used to form the conductive patterns.

BRIEF DESCRIPTION OF THE DRAWINGS

Other objects and advantages of the invention will become apparent upon reading the following detailed description and upon reference to the drawings in which:

FIG. 7(*b*) shows schematically a 5-pole band-pass filter of the invention, with resonators of the type shown in FIG. 1;

FIG. 7(*c*) shows the frequency responses of the filters shown in FIGS. 7(*a*) and 7(*b*), respectively;

Figure 1:
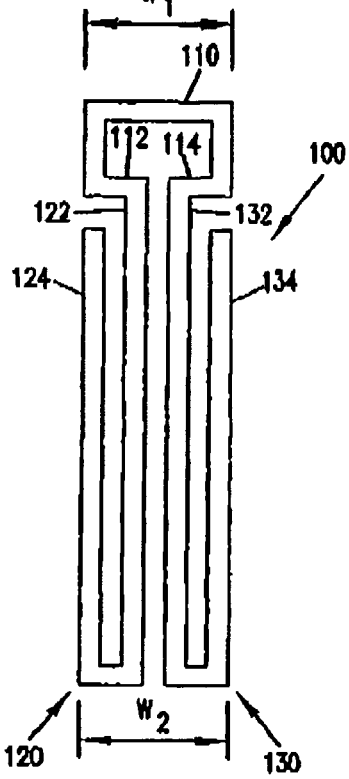
FIG. 1 shows schematically a resonator of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Referring to FIG. 1, according to one aspect of the invention, a resonator 100 is made of a transmission line that can be conceptually divided into three parts: an open loop 110 that terminates at its two ends 112 and 114, a transmission line segment 120 emanating from one end 112 and another segment 130 emanating from the other end 114. Each segment is folded at, for example, approximately the middle point of the segment. Thus, segment 120 is folded into two portions 122 and 124, and segment 130 is folded into two portions 132 and 134. In this configuration, the portions 122 and 132 closer to the loop ends 112 and 114, respectively, are next to, and generally parallel to, each other. The portions 124 and 134 further from the loop ends 112 and 114, respectively, are folded outwardly, away from each other.

The resonator 100 can be viewed as having an orientation that points generally along the folded portions 122, 124, 132, and 134 and toward the loop 110. In this sense, the resonator 100 in FIG. 1 is shown oriented vertically and up.

The loop 110 has a width, $w_1$, in the direction generally normal to the orientation of the resonator 100; the transmission line segments 120 and 130 occupy a footprint that has a width of $w_2$ normal to the orientation. The width $w_1$ of the loop 110 should be sufficiently large. It is believed that a larger size of the loop 110 results in a higher Q for the resonator. Where mechanical filter timing (e.g., by setting the distance between a conductive pad and a portion of a resonator) is employed, it may also be desirable to have a sufficiently large loop 110 to achieve the desired tuning range. To reduce filter size and for other design considerations, which are discussed below, it is desirable to confine the folded segments 120 and 130 to a width $w_2$ that is not substantially larger than $w_1$. For example, $w_1$ can be at least 50% of $w_2$, or as in the specific embodiment shown in FIG. 1, at least about the same as $w_2$.

The filter 100 can be made of conductive materials formed on a dielectric substrate (not shown). The dielectric substrate possesses a ground plane on one side, and on the reverse side possesses the resonator 100. Suitable conductive materials for the conductive materials include metals such as copper or gold and superconductors such as niobium or niobium-tin, and oxide superconductors, such as $YBa_2Cu_3O_{7-d}$ (YBCO). The substrate can be made of a variety of suitable materials, such as magnesium oxide, sapphire or lanthanum aluminate. Methods of deposition of metals and superconductors on substrates and of fabricating devices are well known in the art, and are similar to the methods used in the semiconductor industry.

Figure 2:
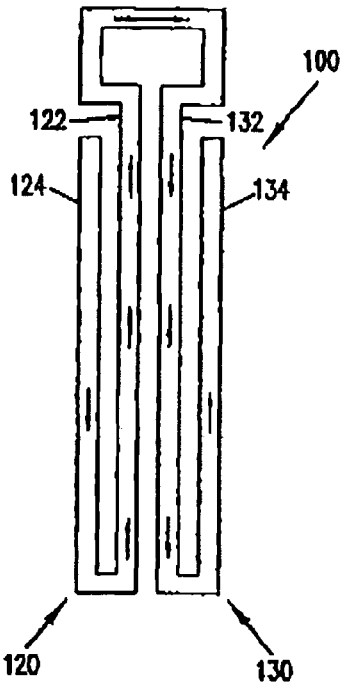
FIG. 2 shows schematically the current distribution in the resonator of FIG. 1.
Figure 3:
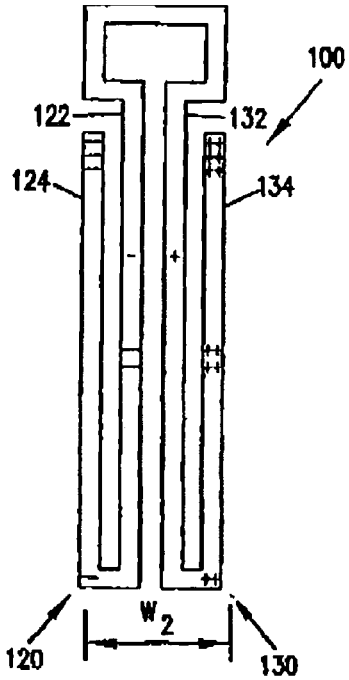
FIG. 3 shows schematically the voltage distribution in the resonator of FIG. 1.

The resonator layout shown in FIG. 1 is thought to produce low electromagnetic radiation into the surrounding medium and therefore low uncontrolled cross-coupling with other similar resonators used in the same filter. As shown in FIG. 2, current, whose direction is denoted by the direction of the arrows and magnitude by the length of the arrows, in the resonator 100 is the largest at the middle point of the transmission line that forms the resonator 100 and near zero in the end regions of the transmission line. Over significant lengths of the adjacent portions 122, 124 and 132, 134, the currents in the two portions are large and flow in opposite directions. Because of the proximity of the two portions 122 and 132, the magnetic fields they produce substantially cancel each other. The electrical fields from different portions of the resonator 100 also to tend to cancel each other out. As shown in FIG. 3, locations of same field strength (denoted by number plus or minus signs in adjacent portions 122, 124 and 132, 134) but opposite field directions are in relative close proximity to each other, at least within the width w2 of the footprint occupied by the transmission line segments 120 and 130. Thus, a significant portion of radiation to the surrounding medium and other resonators is eliminated.

Figure 4:
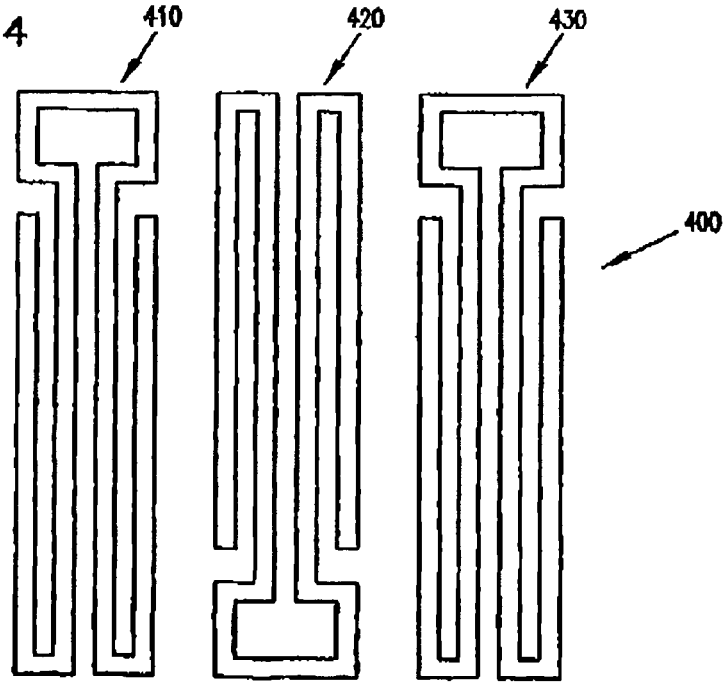
FIG. 4 shows schematically a resonator of the invention.
Figure 5A:
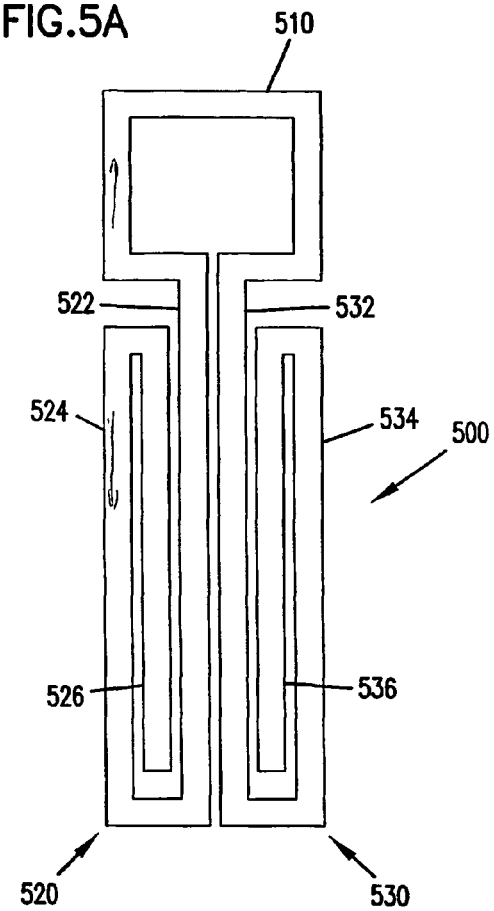
FIGS. 5(*a*)–5(*h*) show schematically examples of the variations in the resonator design according to the invention.
Figure 5B:
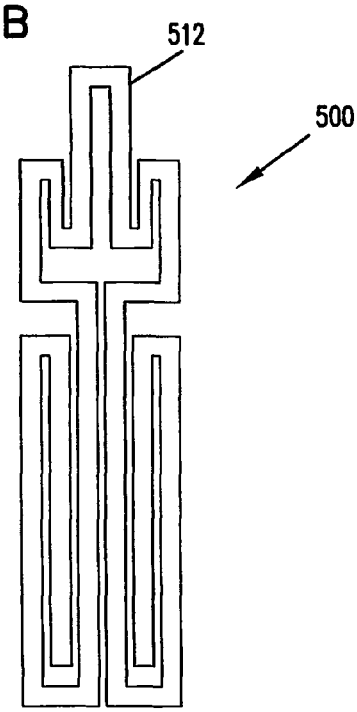
Figure 5C:
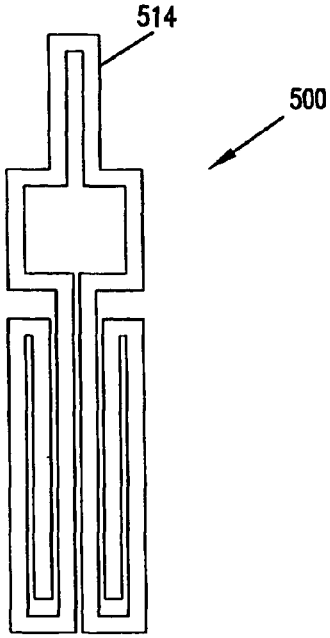
Figure 5D:
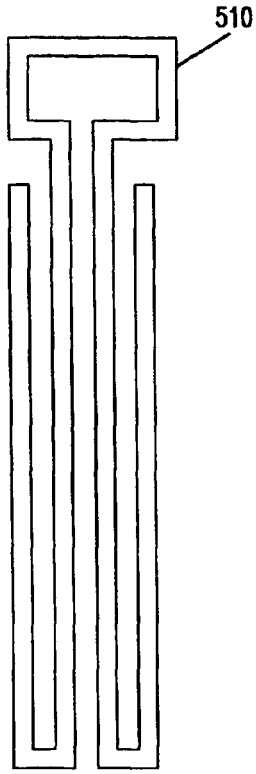
Figure 5E:
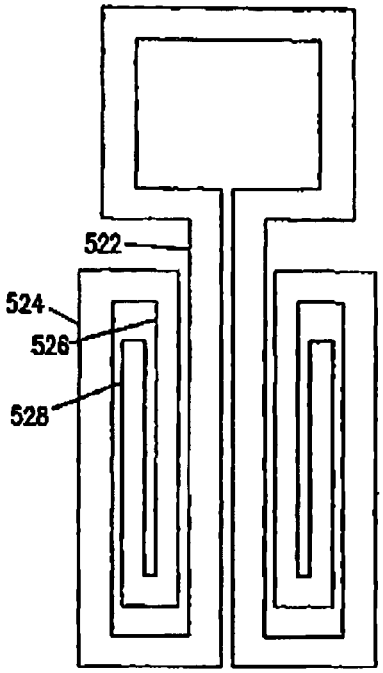
Figure 5F:
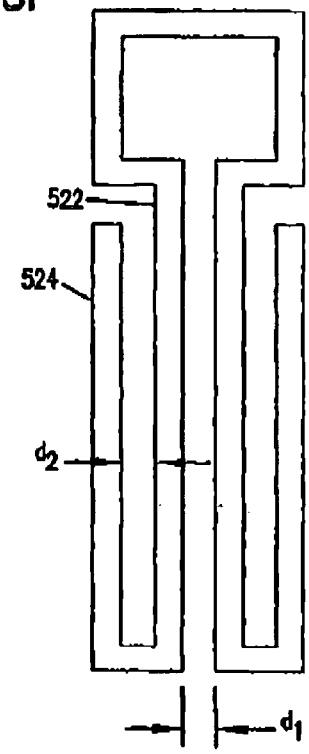
Figure 5G:
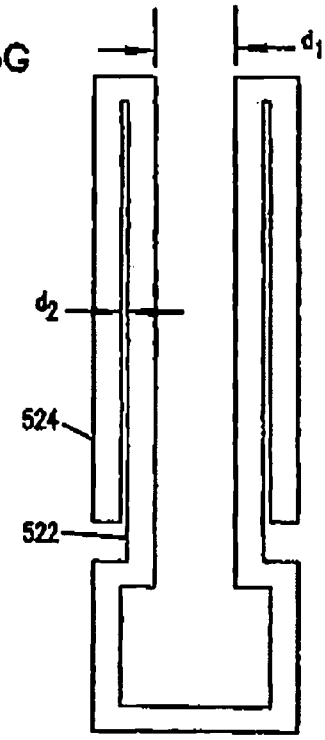
Figure 5H:
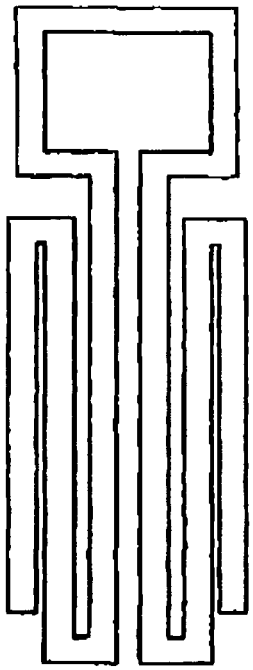

According to another aspect of the invention, a filter can be constructed by using multiple resonators of the invention. For example, as shown in FIG. 4, three resonators 410, 420 and 430 can be placed side-by-side with alternating orientations to produce a three-pole bandpass filter 400. The arrangement of alternating orientations ensures that regions of high magnetic and electrical field are spaced sufficiently apart so that the resonators can be positioned close together for proper coupling between the adjacent resonators and for achieving a more compact filter.

The resonator according to the invention can take on a variety of forms. For example, as shown in FIG. 5(*a*), the transmission line segments 520 and 530 in the resonator 500 can be folded twice into three portions for each segment (i.e., portions 522, 524 and 526 for segment 520; portions 532, 534 and 536 for segment 530). In this configuration, the currents in the vertical segments of the loop 510 flow in opposite directions from the currents in the portions 524 and 534, respectively. The effects of those currents on other resonators thus at least partially cancel each other out.

The center loop 110 can be of a variety shapes. For example, instead of being square- or rectangular-shaped, the loop 110 can be round, elliptical or other suitable shapes. The resonators 500 shown in FIG. 5(*b*) and 5(*c*) have protruding portions 512 and 514, respectively, which, among other things, can facilitate more advantageous placement of conductive pads for mechanical tuning, as discussed above. As shown in FIG. 5(*d*), the loop 510 can also be asymmetrically placed with respect to the folded transmission line segments to accommodate filter circuit layout requirements.

In addition, the transmission line that forms a resonator according the invention need not be uniform in width. For example, as shown in FIG. 5(*e*), the line widths of portions 526 and 528 near the end of the transmission line, where the current is smaller than the other portions (e,g., portions 522, 524), are narrower than the other portions (e.g., portions 522, 524). This design allows a wide conductive path where the currents are high, thereby improving the Q-value of the resonator while achieving a compact resonator size.

The relative spacings $d_1$ $d_2$ between the various portions 522, 524 of the transmission line segments can also be set depending on circuit design needs, as shown in FIGS. 5(*f*) and 5(*g*). The folding of the transmission line segments can also vary. For example, instead of folding a segment twice in the same direction, as shown in FIG. 5(*a*), the transmission line segments can be folded in a zigzag fashion, as shown in FIG. 5(*h*).

Figure 6A:
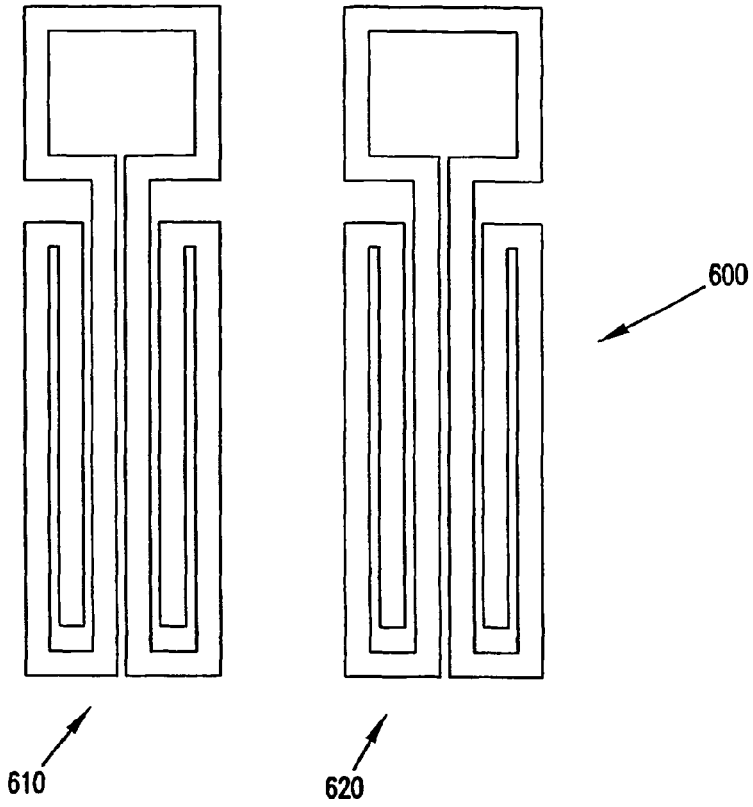
FIGS. 6(*a*) and 6(*b*) show schematically examples of the variations in the orientations and positions of resonators relative to each other in a filter according to the invention.
Figure 6B:
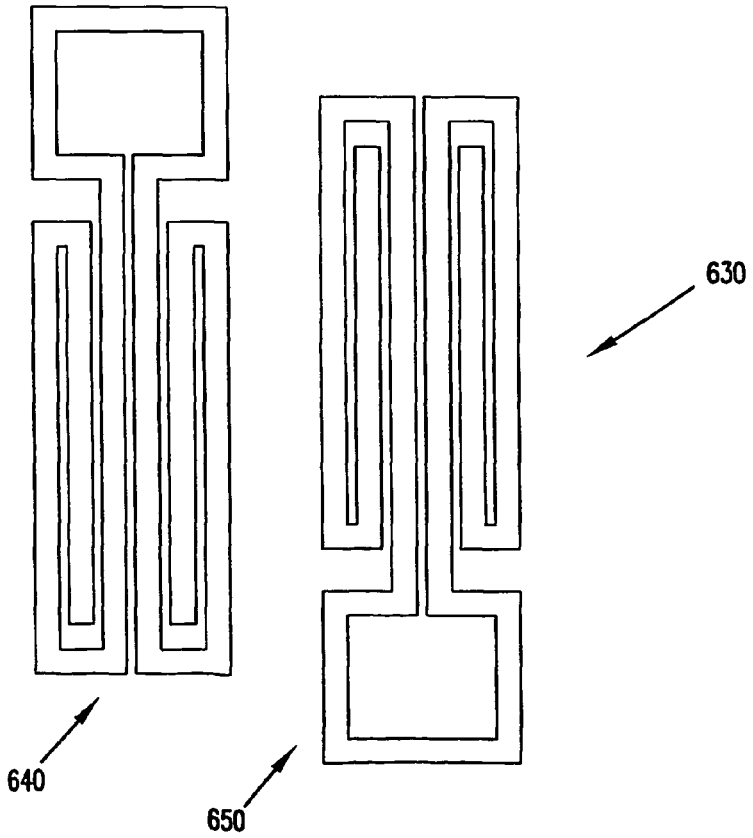

In the filters according to the invention, the resonators can be positioned relative to each other in a variety of ways. For example, as shown in FIG. 6(*a*), the adjacent resonators 610 and 620 in a filter 600 can be positioned parallel to each other, rather than anti-parallel, as is the case shown in FIG. 6(*a*). As further illustrated in FIG. 6(*b*), the resonators 640 and 650 arranged side-by-side in a filter 630 do not have to be aligned in a straight line, but instead can be offset from each other to suit particular filter requirements.

EXAMPLE 1

Figure 7A:
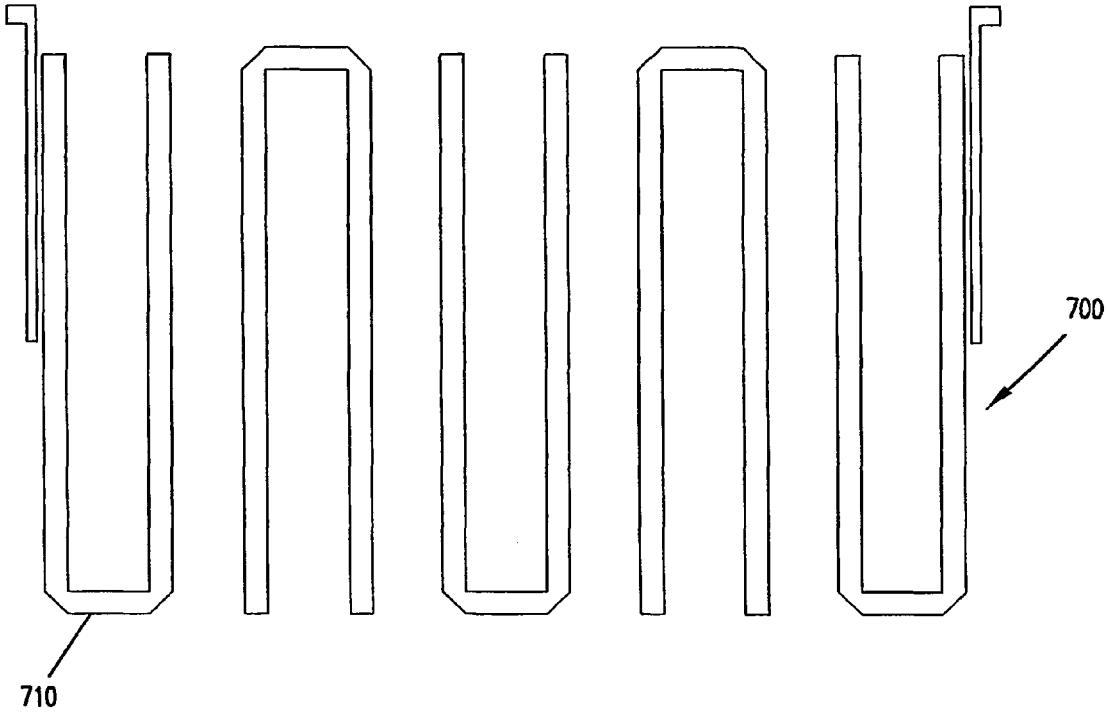
FIG. 7(*a*) shows schematically a 5-pole hairpin band-pass filter.
Figure 7B:
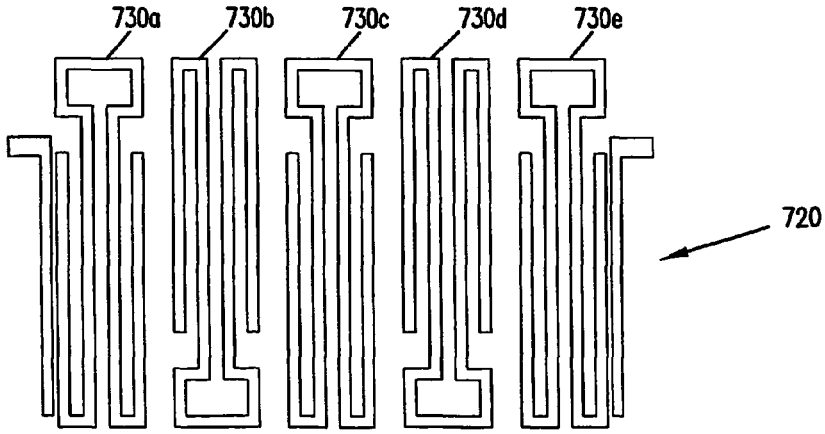
Figure 7C:
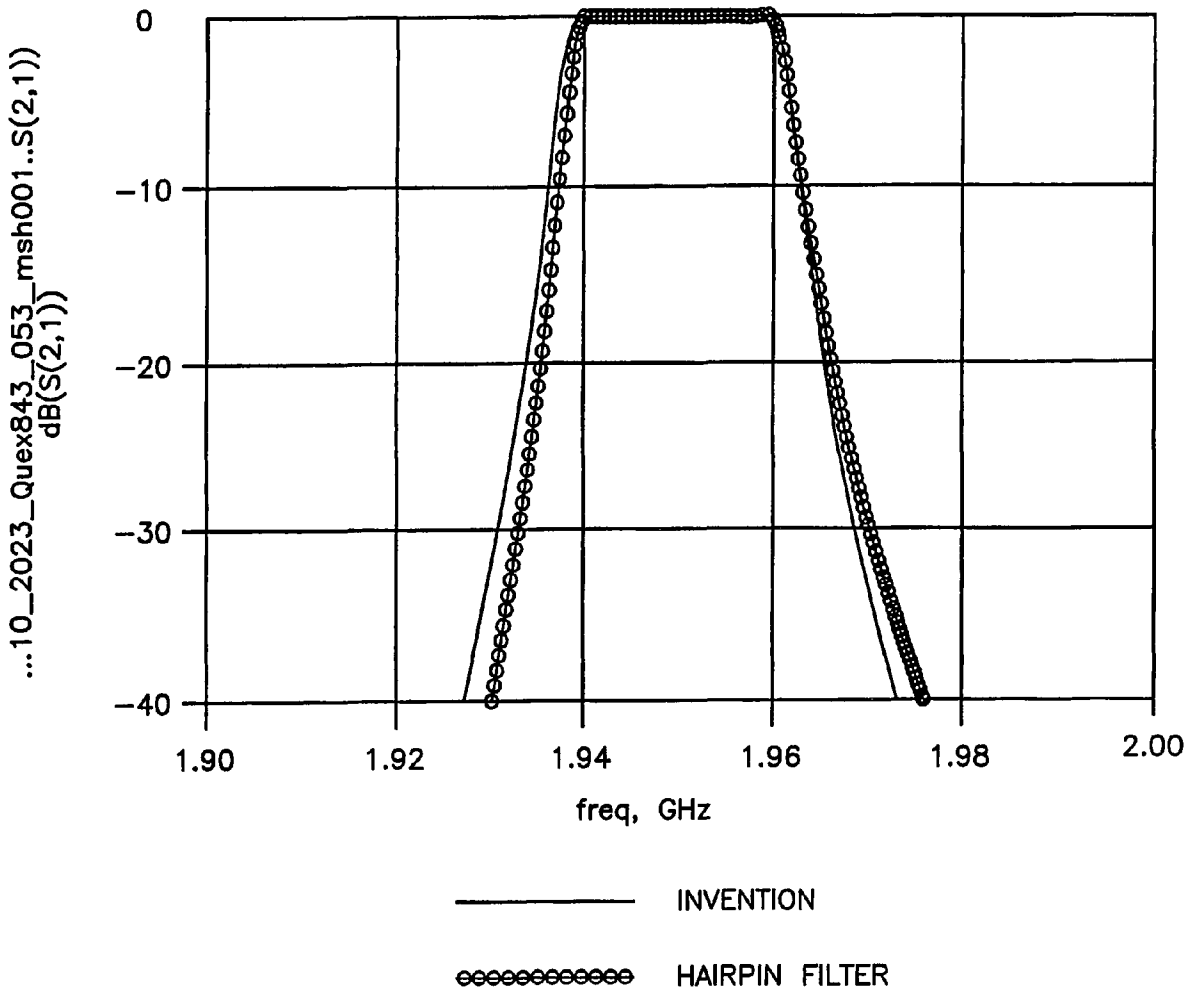

A five-pole bandpass filter of the invention was compared to a 5-pole hairpin filter in computer simulation, as shown in FIG. 7(*a*) and 7(*b*). Both filters have a center frequency of 1.95 GHz and the same bandwidth, 20 MHz (see FIG. 7(*c*)). Both filters were constructed on a substrate 20-mils thickness and having a dielectric constant of 10. The hairpin filter 700, with alternately oriented hairpin resonators 710, had a size of 860 by 630 mils, as shown in FIG.7(*a*). By comparison, the filter 720 of the invention, with alternately oriented resonators 730*a*, 730*b*, 730*c*, 730*d*, 730*e*, of the type shown in FIG. 1, measured only about 630 by 400 mils, or 53% smaller in footprint than the hairpin filter, as shown in FIG. 7(*b*).

EXAMPLE 2

Figure 8:
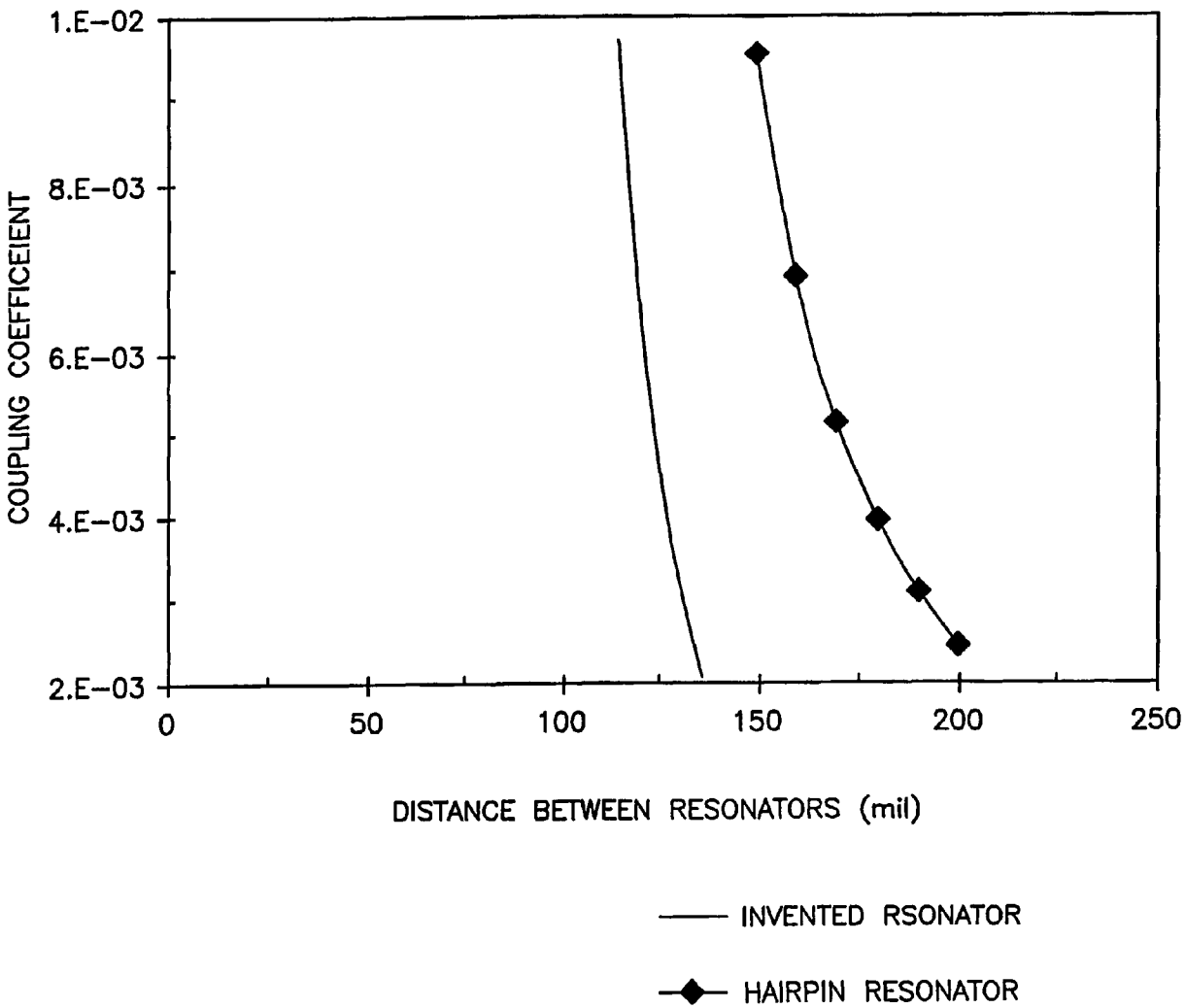
FIG. 8 shows the coupling coefficient as a function of inter-resonator distance for a pair of hairpin resonators and a pair of resonators of the type shown in FIG. 1, respectively.

The coupling coefficient between two resonators of the invention as a function of the inter-resonator distance was calculated and compared to the coupling coefficient for hairpin resonators. As shown in FIG. 8, for the same coupling coefficient, two resonators of the invention can be placed about 50% closer than two hairpin resonators. This fact contributes to the compact filter size achievable using the invention.

EXAMPLE 3

Figure 9A:
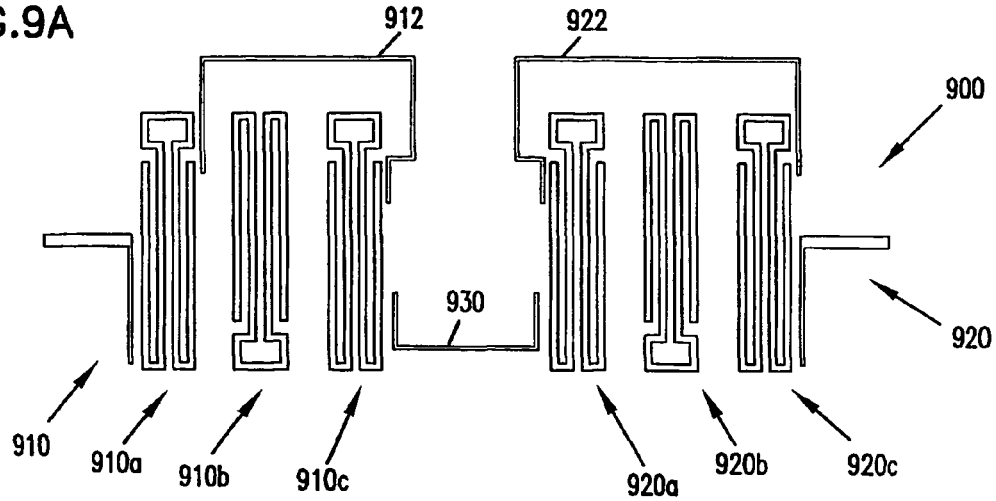
FIGS. 9(*a*) and 9(*b*) show, respectively, the schematic layout of a six-pole filter of the invention and the frequency response of the filter.
Figure 9B:
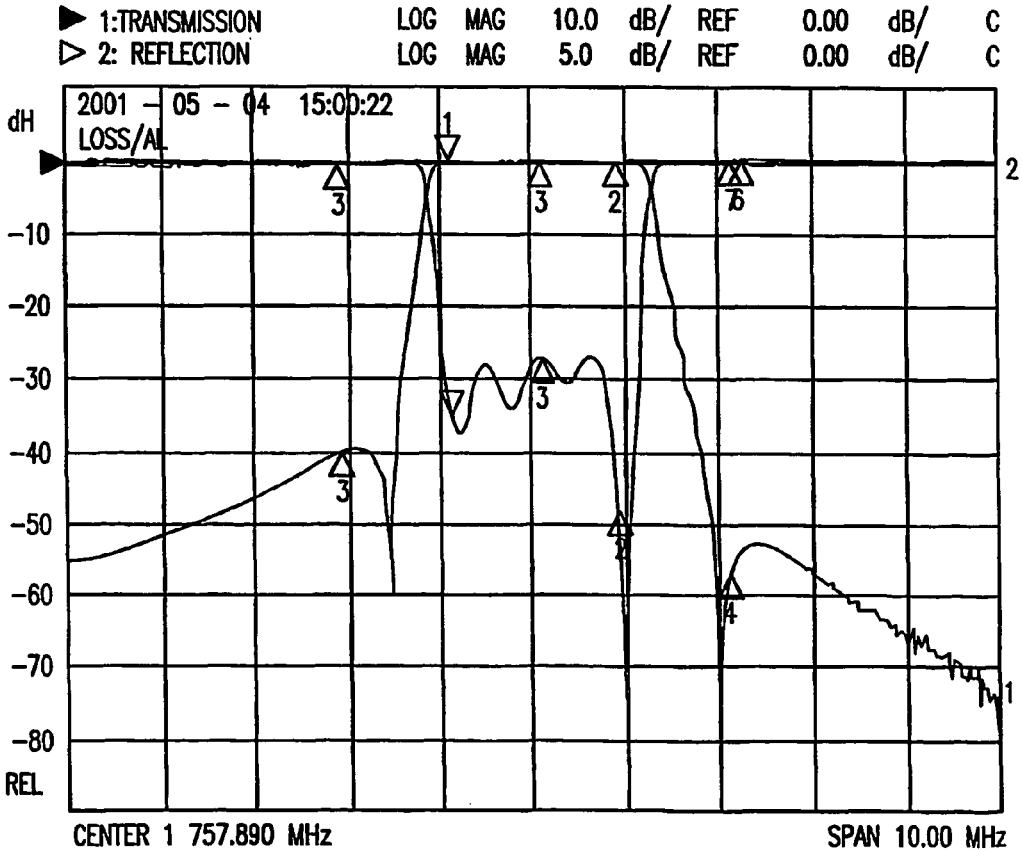

A six-pole filter according to the invention was constructed. The layout of the filter is shown in FIG. 9(*a*). The filter was constructed by forming $YBa_2Cu_3O_{7-d}$ (YBCO) resonator patterns on a magnesium oxide (MgO) substrate). As shown in FIG. 9(*a*), the filter 900 includes six resonators 910*a*, 910*b*, 910*c* and 920*a*, 920*b*, 920*c* divided into two groups 910 and 920 of three. Within each group, the three resonators of the type shown in FIG. 1 are arranged side-by-side in anti-parallel fashion. Resonators 910*a* and 910*c* are coupled together through a linkage including a transmission line 912; similarly, resonators 920*c* and 920*a* are coupled together through a linkage including a transmission line 922. The two groups 910 and 920 are arranged from each other with mirror symmetry relative to an imaginary vertical plane bisecting the two. Furthermore, the two groups are coupled together with a linkage including a transmission line 930 between the two center resonators 910*c* and 920*a*.

As shown in the response curve in FIG. 9(*b*), the filter has a center frequency of 1757.9 MHz, bandwidth of 1.8 MHz and unloaded Q of about 100,000.

EXAMPLE 4

Figure 10A:
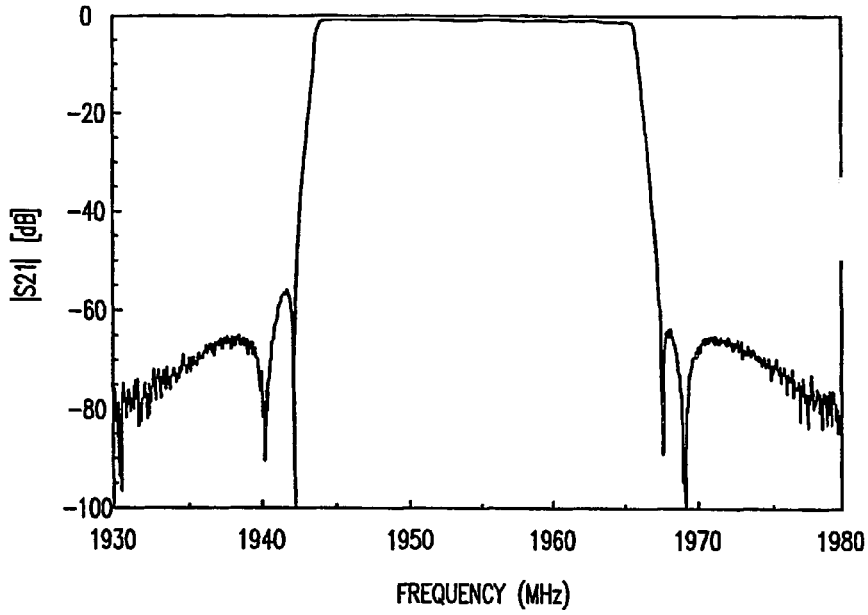
FIGS. 10(*a*) and 10(*b*) show, respectively, the schematic layout of a ten-pole filter of the invention and the frequency response of the filter.
Figure 10B:
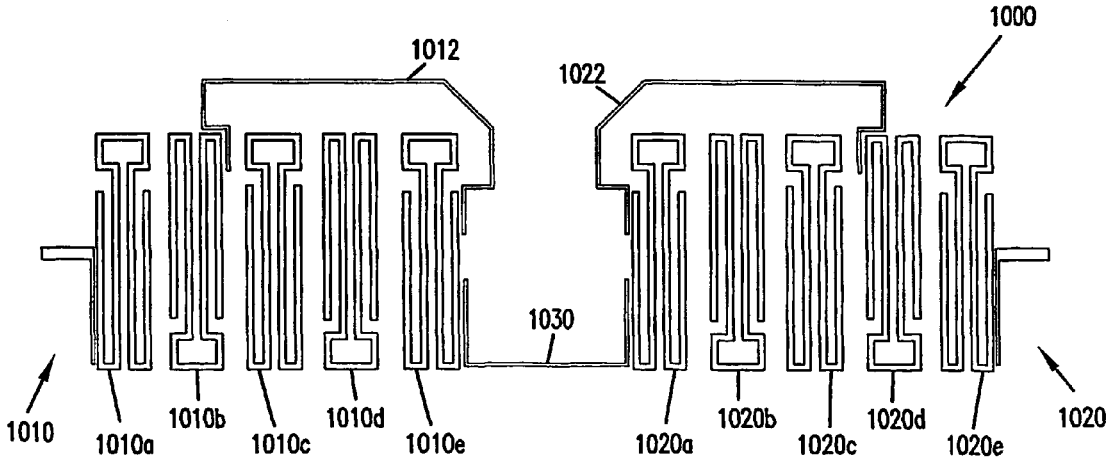

A ten-pole bandpass filter was constructed and tested. The filter was constructed by forming YBCO resonator patterns on MgO substrates. As shown in FIG. 10(*b*), the filter 1000 includes ten resonators 1010*a*, 1010*b*, 1010*c*, 1010*d*, 1010*e*, and 1020*a*, 1020*b*, 1020*c*,1020*d*, 1020*e* divided into two groups 1010 and 1020 of five, each group on its own substrate. Within each group, the five resonators of the type shown in FIG. 1 are arranged side-by-side in anti-parallel fashion. Resonators 1010*b* and 1010*e* are coupled together through a linkage including a transmission line 1012; similarly, resonators 1020*d* and 1020*a* are coupled together through a linkage including a transmission line 1022. The two groups 1010 and 1020 are arranged from each other with mirror symmetry relative to an imaginary vertical plane bisecting the two. The two groups are also divided by a metal wall (not shown in FIG. 10(*b*) but generally illustrated in FIG. 11 as 1152). Furthermore, the two groups are coupled together with a linkage including a transmission line 1030 between the two center resonators 1010*e* and 1020*a*. The frequency response of the ten-pole filter is shown in FIG. 10(*a*).

Figure 11:
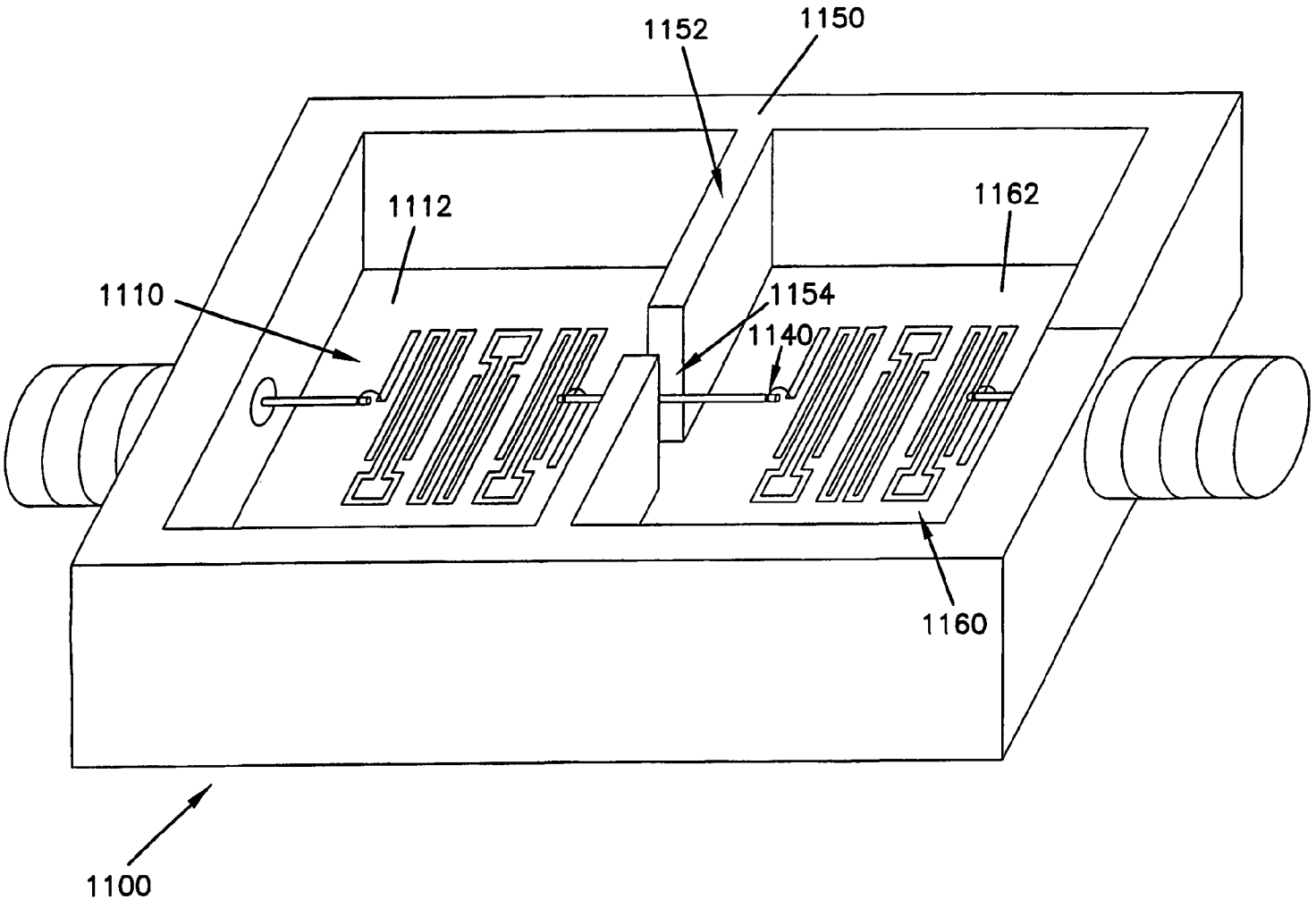
FIG. 11 shows schematically a filter of the invention.

To reduce unwanted cross-coupling, the resonators in a filter 1100 can be divided in to groups formed on their respectively separate substrates, as the example shown in FIG. 11 illustrates. In FIG. 11, each of the substrates 1112 and 1162 and their respective filter components were placed in a chamber 1110 or 1160 in a metal shield package 1150. The two chambers 1110 and 1160 were separated by a metal wall 1152 with a slot 1154 there on to allow any coupling wires 1140 to pass through.

Additional techniques can also be employed to further enhance the filter performances. For example, line widths of the conductive patterns can be selected to be sufficiently large to result in high Q-values and compact filter sizes.

Figure 12:
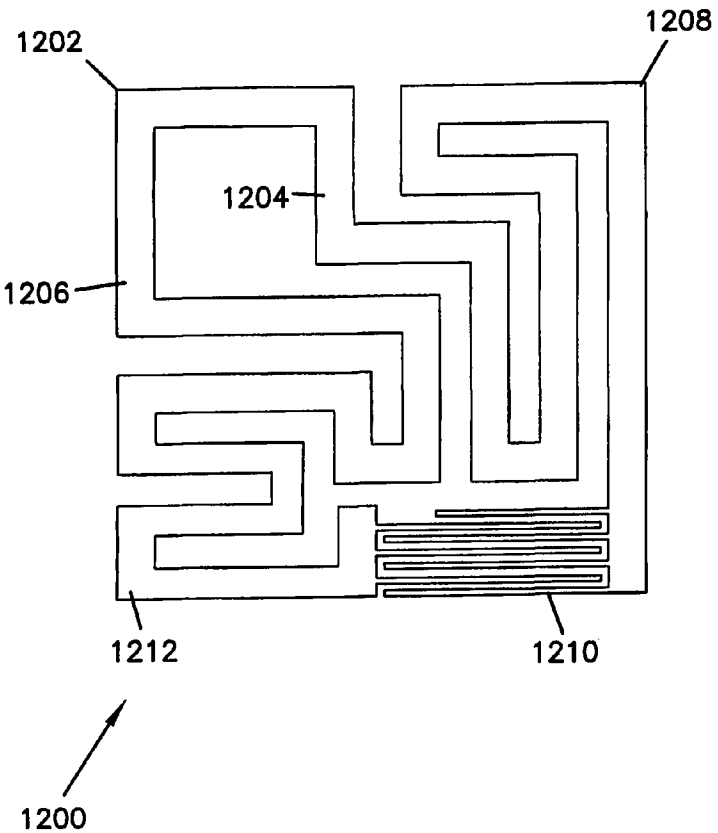
FIG. 12 depicts another embodiment of a resonator in accordance with one aspect of the present invention.

Another embodiment of a resonator 1200 is depicted in FIG. 12. The resonator 1200 of FIG. 12 is susceptible of deployment in any of the exemplary filters disclosed above and in the exemplary filter discussed with reference to FIG. 13. The resonator 1200 of FIG. 12 may be made of the same materials and by the same processes as described with reference to the above-disclosed resonator 100. The resonator 1200 includes a conductive loop 1202, which has a first end 1204 and a second end 1206. Attached to the first end 1204 of the conductive loop 1202 is a first transmission line 1208. The first transmission line 1208 extends from the first end 1204 of the conductive loop 1202 to a first end of an inter-digital capacitor 1210. Similarly, a second transmission line 1212 extends between the second end 1204 of the conductive loop 1202 to a second end of the inter-digital capacitor 1210.

Each of the first and second transmission lines 1208 and 1212 run in a serpentine course, and may be comprised of linear segments, as shown in FIG. 12. The serpentine course of each transmission line 1208 and 1212 may be arranged so that for any linear segment, a parallel segment exists, such that an electrical current circulating through the transmission line 1208 or 1212 runs in opposite directions when passing through the two parallel segments. This arrangement has the aforementioned benefit of cancellation of magnetic fields.

The resonator 1200 of FIG. 12 is more compact than the previously disclosed resonator 100 as a result of employing the interdigital capacitor 1210 and folding the transmission lines 1208 and 1212 a greater number of times. A resonator constructed in accordance with this embodiment may realize a size reduction of 25%. Another benefit of the embodiment of FIG. 12 is reduction in parasitic coupling, which results from a greater degree of field cancellation owing to the greater number of folds of the transmission lines 1208 and 1212.

Figure 13:
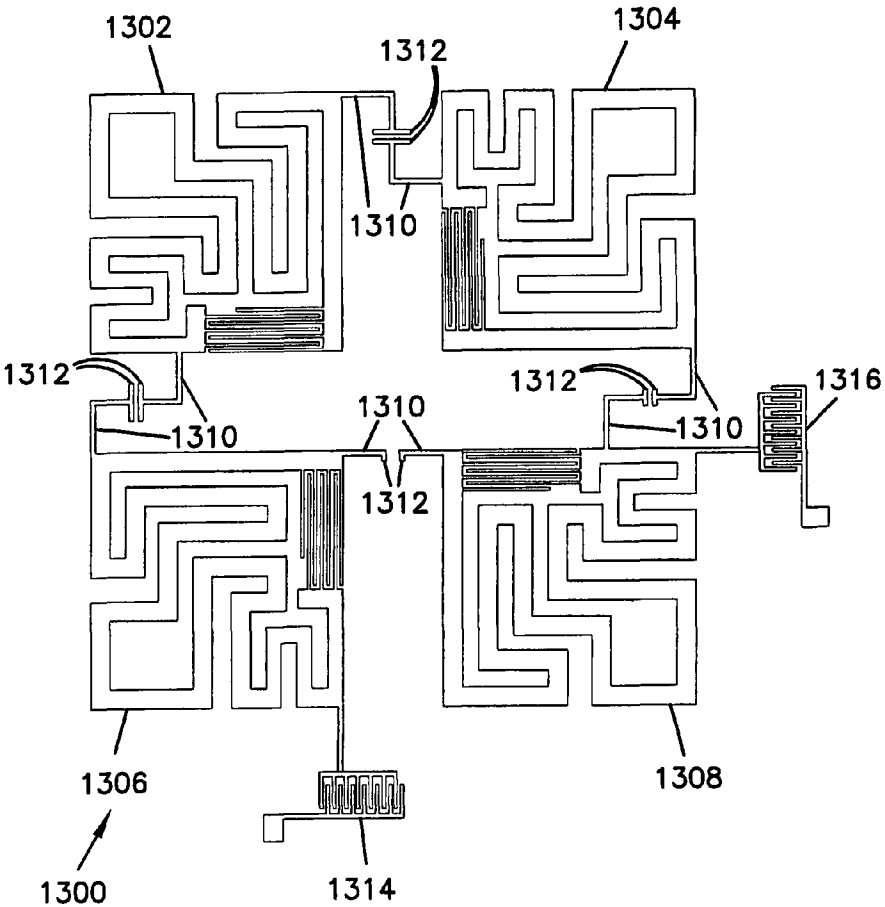
FIG. 13 depicts a four-pole filter constructed of resonators as disclosed in FIG. 12.

FIG. 13 depicts an exemplary four-pole filter 1300 constructed from the resonator 1200 of FIG. 12. The exemplary filter 1300 includes four resonators 1302, 1304, 1306, and 1308 arranged in a substantially rectangular footprint. The resonators 1302, 1304, 1306 and 1308 are constructed in accordance with the embodiment disclosed in the discussion related to FIG. 12. As can be seen from FIG. 13, each resonator 1302, 1304, 1306, and 1308 includes a conductive segment 1310 protruding from each of its transmission lines. The conductive segments 1310 are terminated by another segment 1312 that runs substantially perpendicular to the protruding segment 1310. By juxtaposing a perpendicular segment 1312 from one resonator 1302, 1304, 1306, or 1308 to a perpendicular segment from another resonator 1302, 1304, 1306, or 1308, the two resonators 1302, 1304, 1306, or 1308 are thereby electromagnetically coupled.

Finally, as can be seen from FIG. 13, interdigital capacitors 1314 and 1316 are used to capacitively couple the input and output signal to and from the filter 1300. Interdigital capacitor 1314 is used to input the signal to the filter 1300, and is attached to a transmission line of resonator 1306. Interdigital capacitor 1316 is used to output the signal from the filter 1300, and is attached to a transmission line of resonator 1308.

With the invention, better filter performance can be achieved. Sharper band edges contribute to improved insertion loss and thus the efficiency and bandwidth utilization.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A resonator disposed on a dielectric substrate with a first side and a second side, the first side having a ground plane disposed thereon on, and the second side having a plurality of conductive paths comprising:

(a) a conductive loop terminating in two adjacent ends; and (b) two transmission line segments, each segment emanating from a respective one of the two loop ends and including first portions and second portions, wherein the first portions of the two segments are positioned generally alongside each other, and wherein the second portion of each of the two segments is substantially folded with respect to the first portion of the corresponding segment, whereby the resonator defines an orientation pointing generally along the first and second portions of the transmission line segments toward the conductive loop.

2. The resonator of claim 1, wherein the conductive loop has a first width generally perpendicular to the orientation, and the transmission line segments occupy a footprint having a second width generally perpendicular to the orientation, wherein the first width is at least about 50% of the second width.

3. The resonator of claim 2, wherein the first width is at least about the same as the second width.

4. The resonator of claim 1, wherein the second portion of each transmission line segment comprises at least two portions folded with respect to each other.

5. The resonator of claim 1, wherein the conductive loop and tranmission line segments are primarily made of a superconductor.

6. A filter comprising a plurality of said resonators of claim 1, wherein each of the resonators is coupled to at least another one of the resonators.

7. The filter of claim 6, wherein the resonators are serially arranged in generally side-by-side manner with the orientations of adjacent resonators generally parallel or anti-parallel to each other.

8. The filter of claim 7, wherein the resonators are primarily made of a superconductor.

9. The filter of claim 8, wherein each pair of adjacent resonators have orientations that are anti-parallel to each other.

10. The filter of claim 8, wherein at least one pair of the plurality of resonators are non-adjacent and coupled by a linkage comprising a conductor.

11. A resonator disposed on a dielectric substrate with a first side and a second side, the first side having a ground plane disposed thereon on, and the second side having a plurality of conductive paths comprising:

a conductive loop terminating in a first end and a second end;

an inter-digital capacitor having a first end and a second end;

a first transmission line connecting the first end of the conductive loop to the first end of the inter-digital capacitor, a second transmission line connecting the second end of the conductive loop to the second end of the inter-digital capacitor;

wherein the first transmission line runs in a serpentine course comprised of a plurality of linear segments, such that any one linear segment of the first serpentine transmission line runs parallel to another linear segment of the first serpentine transmission line; and wherein the second transmission line runs in a serpentine course comprised of a plurality of linear segments, such that any one linear segment of the second serpentine transmission line runs parallel to another linear segment of the second serpentine transmission line.

12. The resonator of claim 11, wherein:

for any linear segment of the first serpentine transmission line, a parallel segment exists, such that an electrical current circulating through the first serpentine transmission line runs in opposite directions when passing through the two parallel segments; and for any linear segment of the second serpentine transmission line, a parallel segment exists, such that an electrical current circulating through the second serpentine transmission line runs in opposite directions when passing through the two parallel segments.

13. The resonator of claim 12, wherein the resonator defines a substantially rectangular footprint.

14. The resonator of claim 13, wherein the conductive loop is disposed in one corner of the rectangular footprint and the inter-digital capacitor is disposed in a catercorner corner of the rectangular footprint.

15. A filter comprising:

a plurality of resonators as described in claim 11;

wherein each of the resonators has a conductive segment protruding from at least one of the corresponding first and second transmission lines, and wherein each protruding segment is terminated by a segment running substantially perpendicular thereto; and wherein each perpendicular segment is juxtaposed to another perpendicular segment attached to another resonator, thereby coupling one resonator to another resonator.

16. The filter of claim 15, wherein:

the filter comprises four resonators arranged in a substantially rectangular footprint.

* * * * *

UNITED STATES PATENT AND TRADEMARK OFFICE

CERTIFICATE OF CORRECTION

PATENT NO. : 7,181,259 B2
APPLICATION NO. : 10/480743
DATED : February 20, 2007
INVENTOR(S) : Tsuzuki et al.

It is certified that error appears in the above-identified patent and that said Letters Patent is hereby corrected as shown below:

Col. 4, line 19: "to each other, at least" should read --to each other in the resonator 100, at least--

Col. 4, line 64: "relative spacings $d_1$ $d_2$ between" should read --relative spacings $d_1$, $d_2$ between--

Signed and Sealed this

Eighteenth Day of September, 2007

JON W. DUDAS
*Director of the United States Patent and Trademark Office*